US007284675B2

(12) United States Patent
Chang

(10) Patent No.: US 7,284,675 B2
(45) Date of Patent: Oct. 23, 2007

(54) FOOD PLATE

(76) Inventor: Sun Hui Chang, 2540 College Ave. #202, Berkeley, CA (US) 94704

( * ) Notice: Subject to any disclaimer, the term of this patent is extended or adjusted under 35 U.S.C. 154(b) by 605 days.

(21) Appl. No.: 10/797,453

(22) Filed: Mar. 10, 2004

(65) Prior Publication Data

US 2005/0199635 A1 Sep. 15, 2005

(51) Int. Cl.
*A47G 19/00* (2006.01)
*A47G 21/00* (2006.01)
*A47G 23/00* (2006.01)

(52) U.S. Cl. ..... 220/574; 206/557

(58) Field of Classification Search ..... 220/23.8, 220/62, 574, 575; 206/1.8, 557, 561, 562, 206/564; 229/117.07, 120.08, 120.22, 400, 229/405, 406, 407, 904
See application file for complete search history.

(56) References Cited

U.S. PATENT DOCUMENTS

| | | | | |
|---|---|---|---|---|
| 2,563,455 | A * | 8/1951 | Brown | 206/240 |
| 2,766,919 | A * | 10/1956 | Randall | 294/144 |
| 3,638,849 | A * | 2/1972 | Goings | 229/406 |
| 3,767,108 | A * | 10/1973 | Arneson | 229/106 |
| 5,152,398 | A * | 10/1992 | Forestal et al. | 206/561 |
| 5,390,798 | A * | 2/1995 | Yanuzzi | 206/562 |
| 5,850,910 | A * | 12/1998 | Broyles et al. | 206/1.8 |
| 6,401,927 | B1 * | 6/2002 | Sorensen et al. | 206/562 |
| 6,988,614 | B2 * | 1/2006 | Hemingway et al. | 206/217 |

* cited by examiner

*Primary Examiner*—Anthony D. Stashick
*Assistant Examiner*—Harry A Grosso
(74) *Attorney, Agent, or Firm*—H. Michael Brucker

(57) ABSTRACT

A plate formed from a generally rectangular flat sheet of flexible material that can be configured to be bowed both longitudinally and laterally to form a concave food holding area and a generally flat container-carrying area with a container-holding hole which permits both food and a beverage to be securely held in one hand.

12 Claims, 6 Drawing Sheets

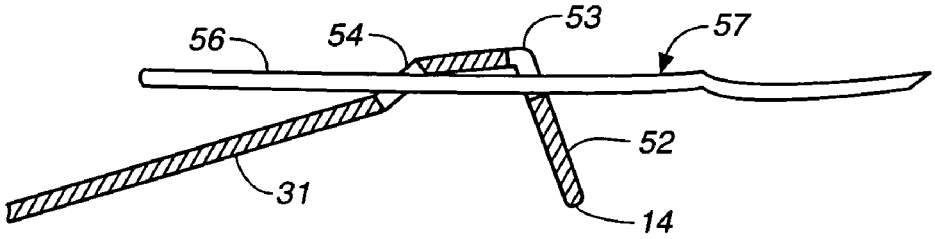
FIG._6
FIG._7A
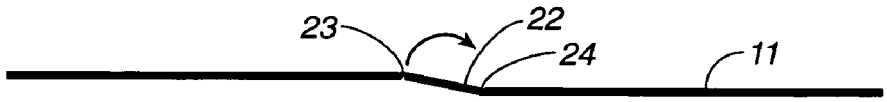
FIG._7B
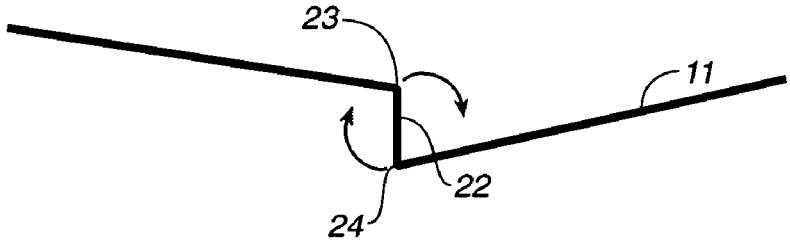
FIG._7C
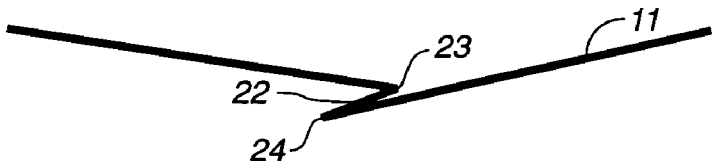

FOOD PLATE

BACKGROUND OF THE INVENTION

The present invention relates to food and beverage holders and, in particular, to a food plate particularly suitable for use under circumstances where food and beverages are consumed while standing.

At cocktail parties, light buffets, when hors d'oeuvres are served, or any other situation where a person holds a plate with food in one hand and a beverage in the other, the need will arise for a free hand (to eat with, to shake hands, scratch an itch, take something from a pocket, use a napkin, etc.) requiring that someplace be found to put down either the food or beverage or both.

The prior art addresses this situation with numerous plates designed to hold a cup or glass and provide space for food. None of these prior art plates, however, have the structural integrity or design elements necessary to securely hold food and a beverage without fear of spilling. In addition, prior art plates that include a beverage-holding feature are typically bulky and require substantial space to transport and store.

BRIEF DESCRIPTION OF THE INVENTION

The present invention solves the problem of having both hands occupied with food and drink by providing a utensil (food plate) that, held in one hand, securely holds both food and a beverage, leaving the other hand free to use a fork, shake a hand, use a napkin, etc.

In one embodiment, the food plate of the present invention is formed from a flat, flexible, generally rectangular sheet of material (plate blank) that remains flat for storage and transportation until used, when it is easily configured to hold both food and a beverage (operative configuration). After use, the plate can be reconfigured back to its flat condition, washed and stored flat until needed.

When configured to its operative configuration, a concave food-holding area is formed near one end and a flattened area with a hole for receiving and holding a (beverage) container is formed nearer the other end. The configured plate is held by one hand at the end nearest the concave food-holding area, with the flat beverage-carrying area cantilevered from the holding hand. The free hand is available for use without having to first put down the food or beverage.

The structure necessary for the cantilevered area to carry the weight of a filled container is provided by a lateral bow (from side edge to side edge) and a longitudinal bow (from one end edge part way to the other end edge) created when the plate is configured. These bows in the flexible plate pre-stress the cantilevered flat area giving it the structure to securely carry the weight of a filled container (e.g., with a beverage). Because of the strength provided by the unique configuration of the plate of the present invention, materials otherwise too light (thin) to support food and a beverage can be used.

To further strengthen the flat beverage-carrying area, the edge of the plate blank along the end distal from where the plate is held is scored so that it can be bent downwardly along a scribed arc. Not only does the bent edge provide added strength, it also provides a foot at the end of the plate which, together with the bottom of the bow that forms the food-carrying area, keeps the plate generally horizontal when the plate is set down on a flat surface and sets the container-receiving hole above the flat surface to keep the container in place.

In another embodiment of the invention, the plate is produced fully configured (bowed) as by a mold or the like. Plates of this embodiment of the invention nest for storage and transportation.

Accordingly, it is an object of the present invention to provide an eating utensil (food plate) which, when held in one hand, securely supports food and a beverage.

It is another object of the present invention to provide a generally flat, generally rectangular food plate blank of flexible material that can be easily and quickly configured into a food plate that securely supports food and a beverage when held in one hand.

It is yet another object of the present invention to provide a generally flat, generally rectangular food plate blank of flexible material that can be made to bow both laterally and longitudinally by the quick engagement of a fastener.

Still another object of the present invention is to provide a food plate that is held in one hand and securely supports a container of a beverage at a distance from the holding hand.

The invention possesses other objects and advantages, especially as concerns particular characteristics and features thereof which will be better understood from the following detailed description of the preferred embodiments when read in conjunction with the appended drawing figures.

BRIEF DESCRIPTION OF THE DRAWINGS

FIG. 6 is a sectional view taken along the line 6-6 of FIG. 3;

FIG. 7A is a sectional view taken along the line 7*a*-7*a* of FIG. 1;

FIG. 7B is the same as FIG. 7A, but with the plate partially configured;

FIG. 7C is a sectional view taken along the line 7*c*-7*c* of FIG. 3 in which the plate is fully configured;

DETAILED DESCRIPTION OF THE PREFERRED EMBODIMENTS

Figure 1:
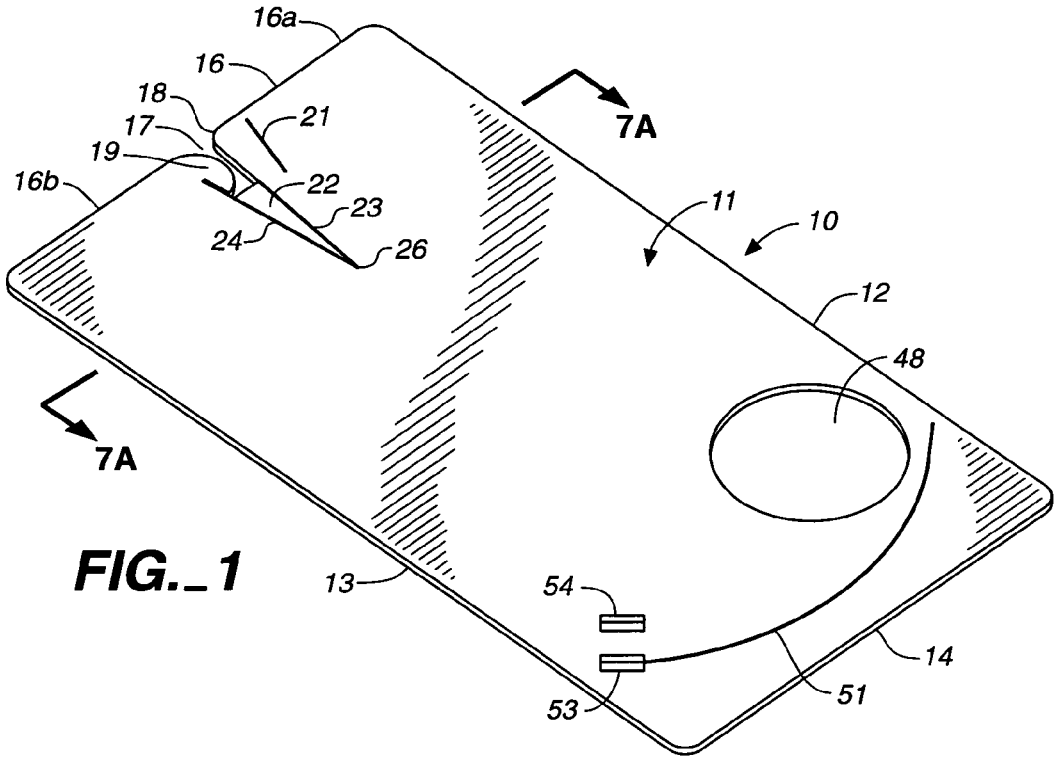
FIG. 1 is an upper front left perspective view of the plate blank of the present invention.

Referring to FIG. 1, a flat plate blank 10 of the present invention is formed from a thin, generally rectangular sheet of flexible material 11 which has opposing two side edges 12 and 13 and opposing end edges 14 and 16. The plate blank 10 can be formed from any one of several flexible materials including plastic, paper, paper-plastic combinations or any other suitably flexible and waterproof or semi-waterproof material. The specifications for the flexible material 11 necessary to carry out the functions of the invention will be obvious to those skilled in the art from this description. One such material, for example, is 1/32" thick polyethylene.

End edge 16 is split into sections (end areas) 16*a* and 16*b* separated by a space 17. The space 17 is defined on one side by edge 18 which is contiguous with end edge section 16*a*. The other side of space 17 is defined by a rounded hook 19. A slit 21 is formed in the material 11 adjacent space 17 near edge 18 and sized to receive and hold hood 19. A triangular gusset 22 is formed below space 17 by a score line 23 which extends from edge 18 to a point 26, and a score line 24 which extends from hook 19 to point 26. The gusset 22 extends longitudinally from space 17 toward end edge 14.

Figure 2:
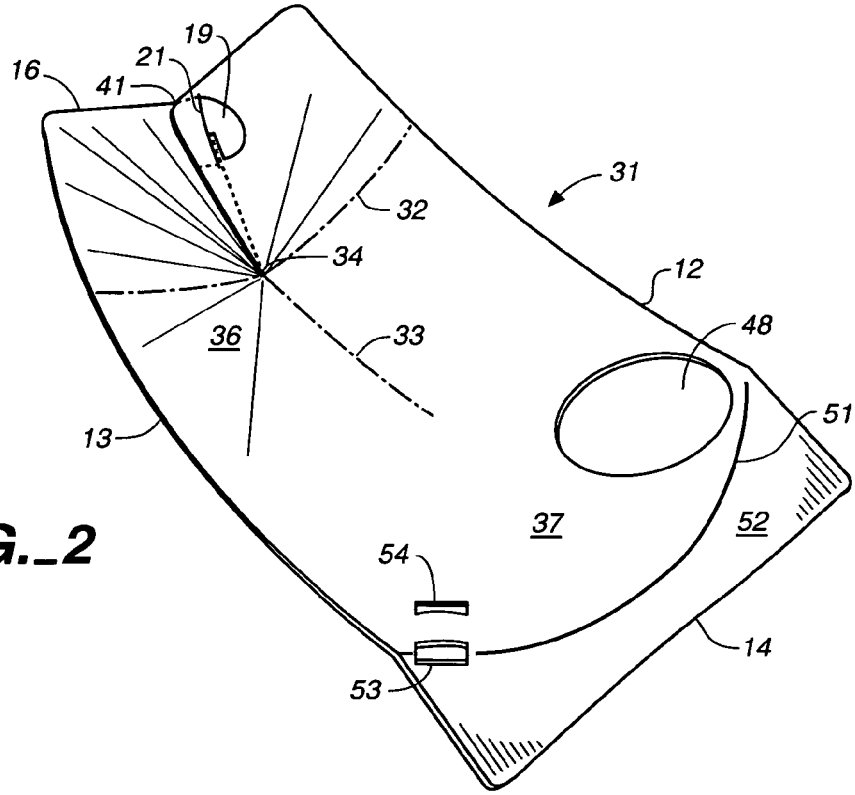
FIG. 2 is an upper front left perspective view of the plate of the present invention in its configured condition.

Referring also to FIG. 2, the plate blank 10 is configured into a utensil (food plate) 31 by inserting hook 19 into slip 21, causing material 11 from end area 16*a* and end area 16*b* on either side of space 17 to overlap. By overlapping material 11 from either side of space 17, the plate blank 10 is stressed, causing the material 11 to bow both longitudinally and laterally as more fully described below.

The hook 19 and slit 21 are a very advantageous mechanical device for locking the blank 10 in a stressed overlapping configuration to form plate 31. The advantages are that the hook 19 and slit 21 are formed from, and are an integral part of, the same material as the blank 10 itself, requiring no additional elements to be affixed to the material 11. The mechanical means for holding the blank 10 in a stressed overlapping configuration to form plate 31 are not, however, limited to the hook 19 and slit 21 illustrated. Because, in one embodiment, it is contemplated that the plate 31 will be reconfigured back to its flat condition, as shown in FIG. 1, it is desirable that the means for maintaining the material 11 configured into plate 31 be easily reversible. This is well provided by the hook 19 and slit 21 illustrated. It will be equally evident to those skilled in the art that the actual shape of the hook 19 could vary from that illustrated and still perform the function described.

Figure 3:
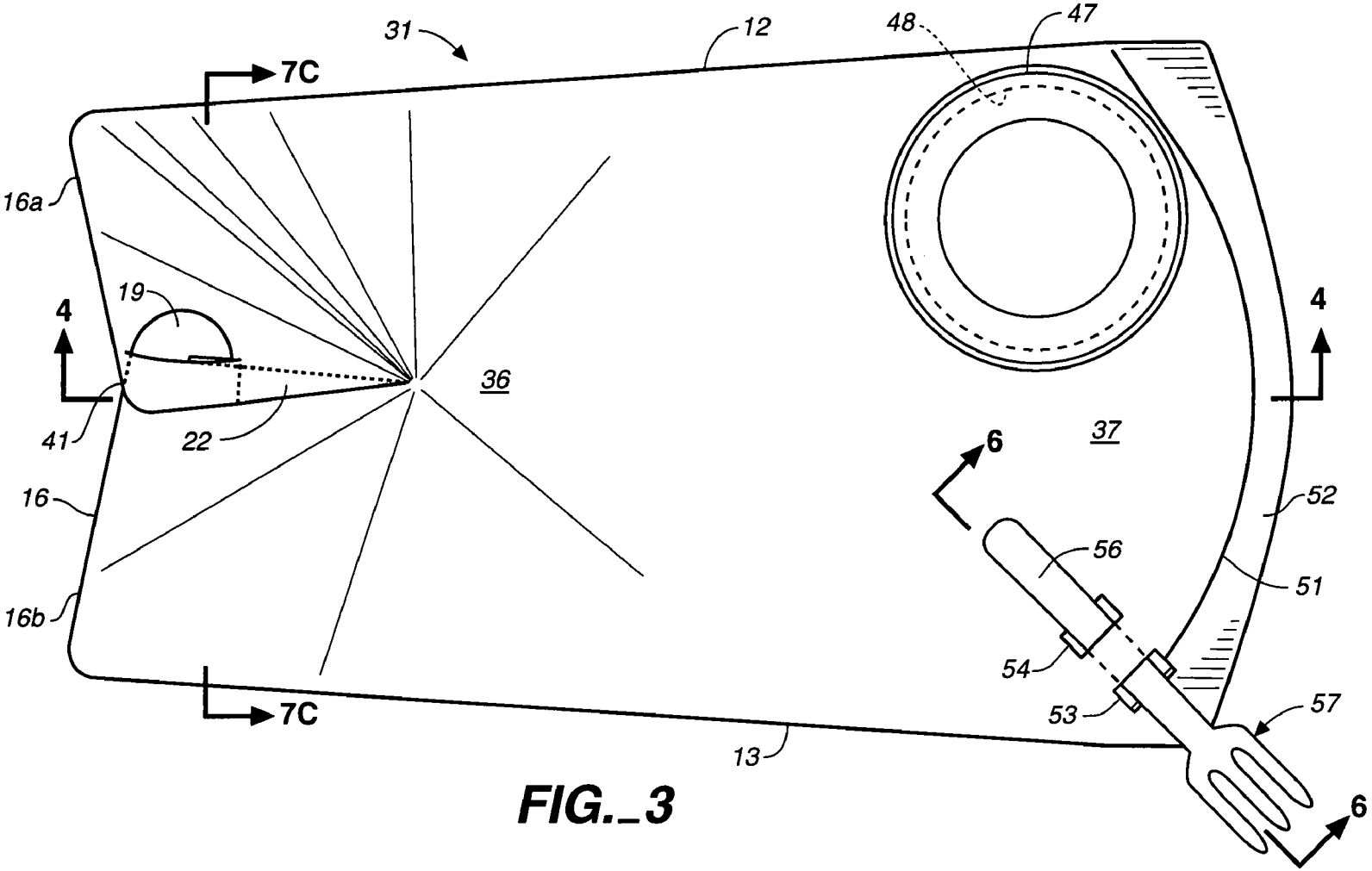
FIG. 3 is a top plan view of the invention in its configured condition shown together with a fork and beverage container.
Figure 4:
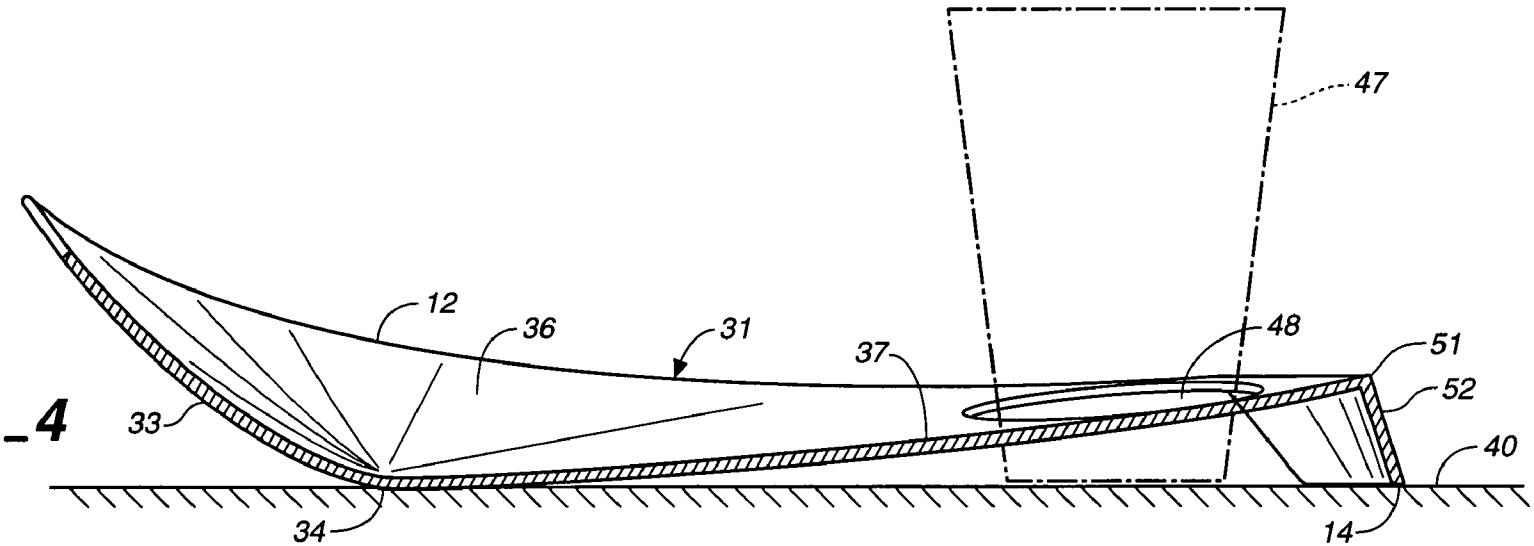
FIG. 4 is a side sectional view taken along the line 4-4 of FIG. 3.
Figure 5:
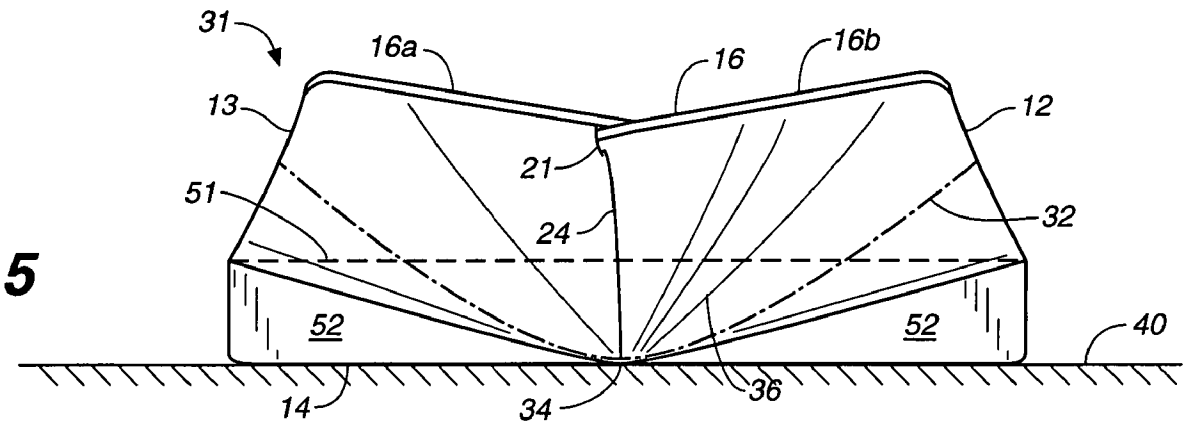
FIG. 5 is a front elevation view.

Referring also to FIGS. 3, 4 and 5, when the material from end areas 16*a* and 16*b* are held in an overlapping configuration, the material 11 is automatically caused to flex. By having the space 17 and gusset 22 located approximately midway between side edges 12 and 13, the flex of material 11 produces both a lateral bow 32 and a longitudinal bow 33. The lateral bow 32 extends from side 12 to side 13, nearer to end edge 16 than edge 14, with its low point (apex) 34 approximately midway between the side edges 12 and 13. The longitudinal bow 33 extends from end edge 16 to between one quarter and three quarters of the distance to end edge 14, with its low point (apex) 34 at the approximate midpoint of longitudinal bow 33. Together, the lateral bow 32 and longitudinal bow 33 form a concave generally conical-shaped food-holding area 36 in the area of plate 31 nearer to end edge 16. Between food-holding area 36 and end edge 14 is a beverage-holding area 37 which remains essentially flat after the blank 10 is configured into plate 31. The bows 32 and 33 pre-stress the generally flat container-holding area 37 enabling it to support the weight of a glass container (for example) filled with fluid.

The triangular-shaped gusset 22 extends into the general area of the food-holding area 36. As best seen with reference to FIGS. 7A-7C, before the blank 10 is configured into plate 31, the gusset 22 fills a triangular space between score lines 23 and 24. As the hook 19 is drawn toward slit 21, the gusset 22 rotates about line 22 until the gusset overlays the material 11 and score lines 23 and 24 have reversed relative positions. In this way, the distance between side edges 12 and 13 in the area of gusset 22 is reduced, causing the bows 32 and 33 in the material 11 as previously described. The gusset assures that the material in the concave food-holding area 36 is continuous and thereby prevents fluids that might accumulate in the food-holding area from leaking out the bottom of the plate. Where such leakage is not a consideration (such as when only dry materials are to be used), the gusset 22 can be eliminated and the space between score lines 23 and 24 left open, forming one space with space 17.

Figure 8:
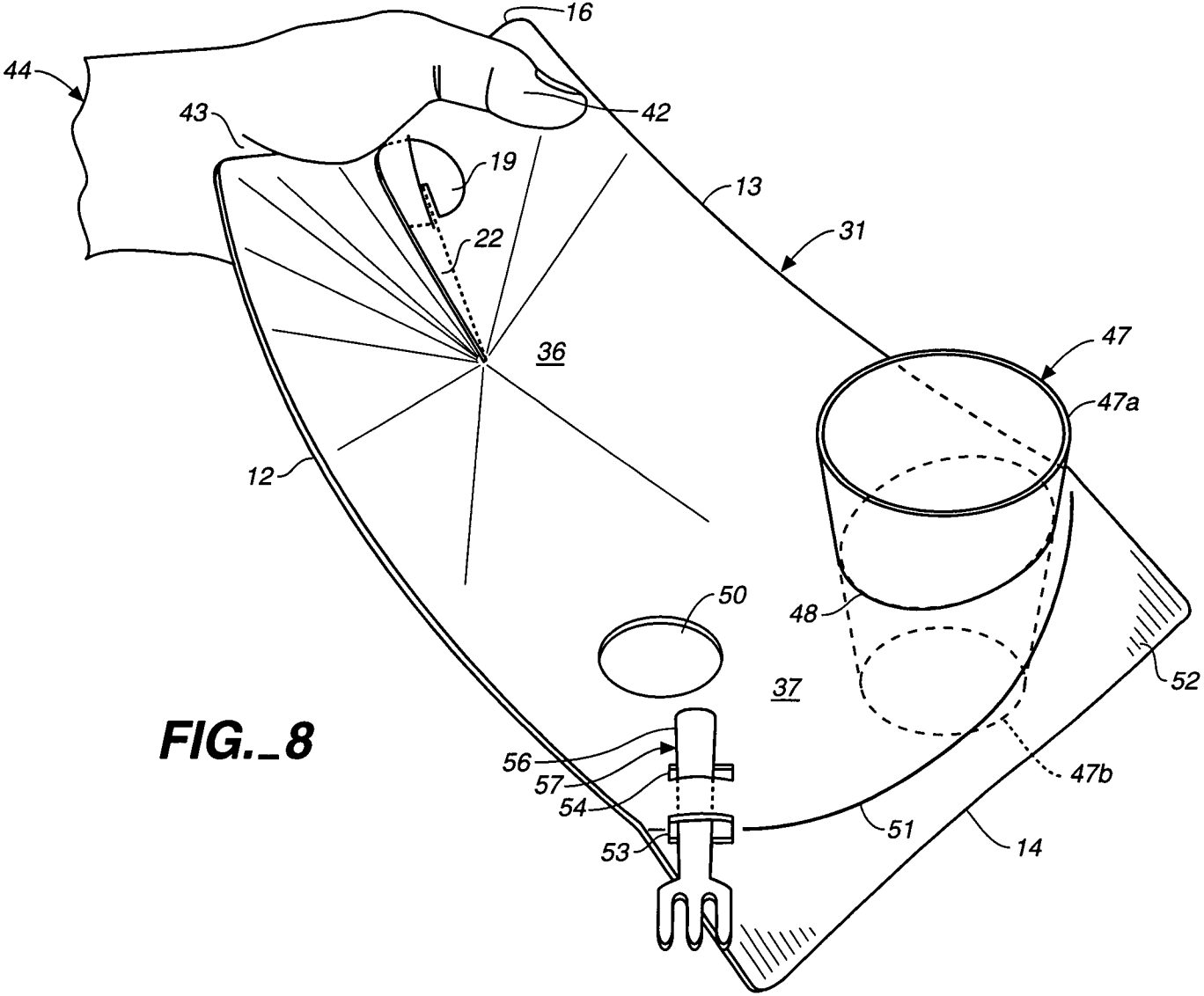
FIG. 8 is an upper left perspective view of the plate of the present invention in its configured condition shown in use with a glass and fork.

When hook 19 is locked into slit 21, the space 17 is closed and end edge sections 16*a* and 16*b* overlap, creating a recess 41 in end edge 16 (approximately midway between side edges 12 and 13). The recess 41 fits naturally into the notch between the thumb 42 and palm 43 of a hand 44 holding the plate 31, as best seen in FIG. 8. When the plate 31 is so held, the fingers 46 (most not shown) and palm 43 of the hand 44 are automatically positioned below and cradle the concave food-holding area 36, while the thumb 42 applies pressure near end edge 16 that keeps the plate 31 firmly in the hand 44. In this way, the plate 31 is securely held by the entire hand in a natural, relaxed position.

Referring to FIG. 8, a hole 48 is provided in plate 31 in the generally flat beverage-holding area 37 near the end edge 14 and preferably (but not necessarily) off to one side. The hole 48 is sized to receive a tapered container 47 (e.g., a drinking vessel made of glass or plastic or paper) and permit a portion of the container 47 to pass below the plate 31 before engaging and holding it somewhere between its top 47*a* and its bottom 47*b*. By allowing a portion of the container 47 to rest below plate 31 (rather than simply be balanced on top in a recess), the possibility of the container 47 falling off the plate is eliminated. While the container 47 has been referred to as a beverage container, it will occur to those skilled in the art that the container 47 can also serve to hold a snack, such as nuts or chips or a sauce or any other food or condiment that might be desired to have handy. When it is desired to provide for holding both a container 47 for a beverage and a second container for a sauce or condiment, a second hole 50 is provided. Because the generally flat container-holding area 37 is pre-stressed by the bows 32 and 33, the contents of the container 47 and/or a container (not shown) in hole 50 are securely supported even though the weight of the containers and their contents is applied at the cantilevered area 37. It is advantageous to have the food-holding area 36 nearer to the hand 44 than the container-holding area 37 so that it is not necessary to reach over the container 47 to gain access to food in food-holding area 36.

Referring also to FIG. 4, in the use of plate 31, it is contemplated that, from time to time, it may be desired to put plate 31 down on a horizontal surface 40 while it contains food and/or a container 47. To prevent the food from spilling when the plate is put down and to keep container 47 engaged in hole 48, it is desirable that the food-holding area 36 remain generally horizontal and the container-holding area 37 be elevated above surface 40.

Referring to FIGS. 4 and 8, an arcuate score line 51 is provided spaced-apart from but adjacent end edge 14 which permits an end edge 14 to be folded down about the score line 51, forming a foot 52. The score line 51 is spaced from end edge 14 a distance such that when end edge 14 is bent down to form foot 52, the end edge 14 is at approximately the same level as the low point (apex) 34 of intersecting bows 32 and 33. When placed on a longitudinal surface 40, the apex 34 and end edge 14 are in the same longitudinal plane whereby the food-holding area 36 remains generally horizontal so as not to spill its contents. In addition, the area 37 between the low point 34 and foot 52 is elevated above the horizontal surface 40 so as to keep the container 47 engaged.

In addition to providing a foot 52 to support the distal end of plate 31, the fold along score line 51 also provides additional structural support at the cantilevered area of the container hole 48 when the plate 31 is being held.

Referring to FIGS. 3 and 6, a first utensil slot 53 is formed at the score line 51 near the side edge 13 (the edge furthest from the container hole 48), and a second utensil slot 54 is formed in material 11 a short distance from, and aligned with, slot 53 and on the other side of score line 51 from end edge 14. The slots 53 and 54 are sized to receive the handle 56 of a utensil 57 (illustrated as a fork, but could just as well be a spoon, knife, toothpick(s), chopsticks or any other utensil having a portion that fits into slots 53 and 54) which is readily available when needed and conveniently stored when not being used. The slot 53 being at the score line 51 is fully exposed when the foot 52 is formed by folding down end edge 14, making it easy to locate the utensil handle 56 into the slots 53 and 54. The placement of slots 53 and 54 relative to container hole 48 makes the utensil 57 accessible without having to reach over a container 47 in hole 48.

The invention has been illustrated in a configuration best suited to a right-handed person holding the food tray 31 in the left hand. The placement of the utensil slots 53 and 54 and container hole 48 could be reversed to provide the advantages of the invention to a left-handed person holding the plate in the right hand.

Figure 9:
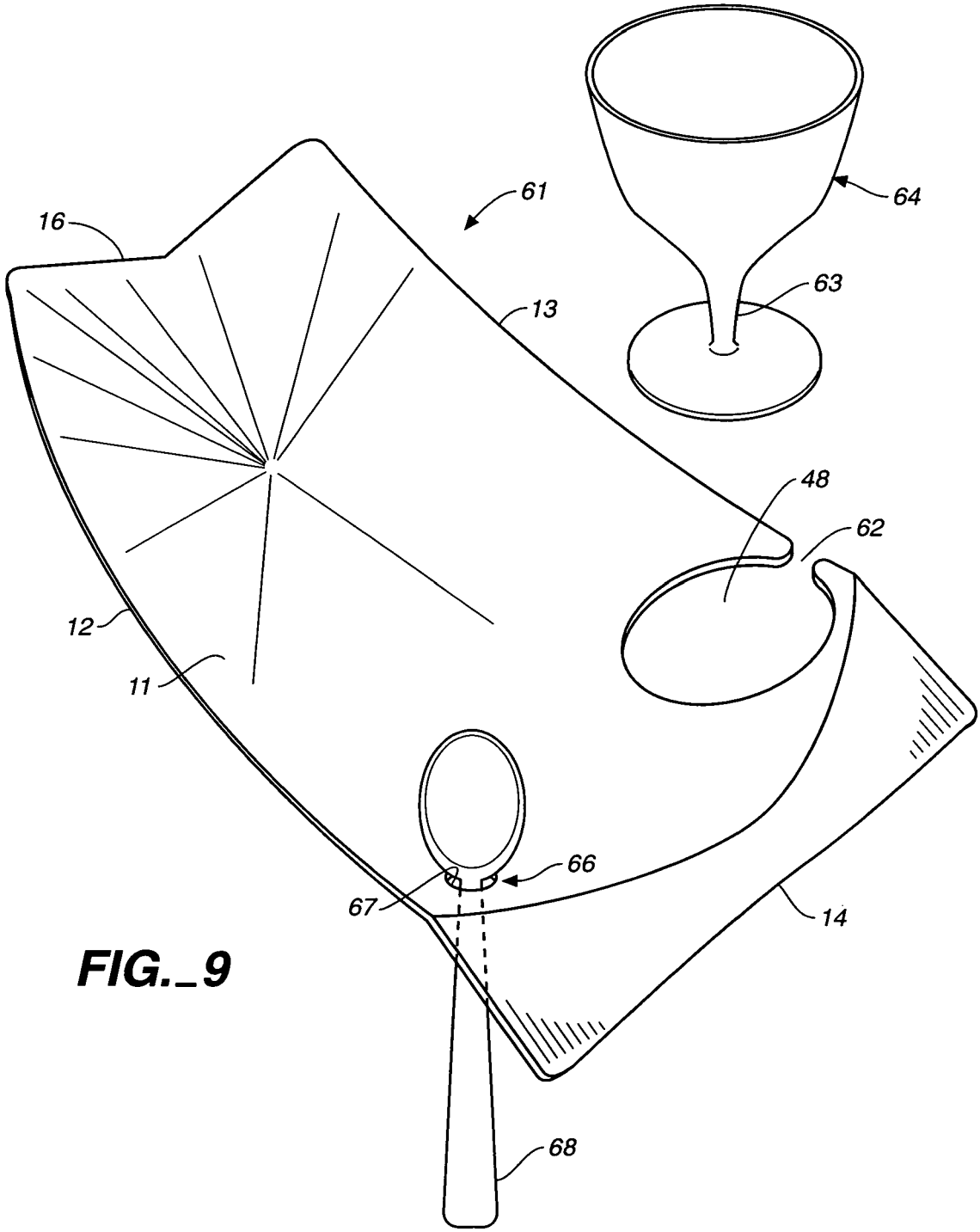
FIG. 9 is an upper front left perspective view of an alternative embodiment of the present invention shown together with a spoon and stemmed beverage container.

Referring to FIG. 9, in an alternative embodiment, a food plate 61 is formed fully and permanently configured. All of the structural attributes described above inure to this embodiment, other than the ability to be stacked flat. The trays 61 do nest, however, for convenient packaging, storage and transportation.

A narrow channel 62 is formed between container hole 48 and side edge 12 to permit passage of the stem 63 of a wine glass 64. This feature can also be used with the configurable embodiment described above.

A hole 66 in material 11 serves as an alternative utensil holder into which a spoon 68 (or fork) can be placed and held when not in use. An embodiment of the invention using utensil holder 66 (hole), a small container hole 50 (FIG. 8) and a beverage container hole 48 would have three holes, all fully supported by area 37 when occupied.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A convertible food tray comprising:

a generally flat, rectangular sheet of flexible material of generally uniform thickness having a bottom side and a top side, two spaced-apart generally parallel side edges, and first and second spaced-apart generally parallel end edges;

a split in said sheet generally parallel to said side edges at approximately the midpoint of said first end edge extending from said first end edge toward said second end edge and dividing said sheet in the area of said first end edge into a first end area and a second end area;

wherein when said material from said first end area and said second end area are brought into an overlapping configuration at said split, said sheet of flexible material is caused to bow from side to side and from said first end edge to between one quarter and three quarters of the way to said second end edge, forming a concave area and a generally flat, pre-stressed area in said sheet wherein said sheet in said concave area has a general conical shape with an apex at its approximate center, and further wherein said sheet in the area of said apex is continuous whereby liquid material can be retained in said concave area and wherein said generally flat pre-stressed area in said sheet extends from and between said two side edges and from said concave area to said second end edge; and further wherein when material from said end areas are not in an overlapping configuration and in their original side by side configuration, said sheet can be returned to its generally flat condition for storage and/or transport.

2. The convertible food tray of claim 1 further comprising:

an arcuate score line in said top side of said sheet in said flat area generally aligned with and spaced apart from said second end edge whereby when said sheet is folded along said score line, the portion of said sheet between said score line and said second end edge depends from said top side toward said apex of said concave area and forms a foot for said food tray and further strengthens said generally flat area.

3. The convertible food tray of claim 2 wherein when material from said end areas are in overlapping configuration and when said sheet is folded along said score line, the portion of said sheet between said score line and said second end edge depends from said top side a distance that disposes said second end edge and said apex of said concave area generally in the same horizontal plane.

4. The convertible food tray of claim 2 further comprising a container retaining hole in said generally flat area between said concave area and said arcuate score line.

5. The convertible food tray of claim 2 further comprising:

a hook formed in said first end area of said sheet at one side of said split; and a slit formed in said second end area of said sheet on the other side of said split for receiving and retaining said hook whereby when said hook is inserted into and retained in said slit, said first end area and said second end area are brought into an overlapping configuration.

6. The convertible food tray of claim 1 wherein when said first end area and said second end area are brought into an overlapping configuration, a recess is thereby formed at said split in said first end edge approximately midway between said side edges for receiving the area of a hand between the thumb and the palm.

7. The convertible food tray of claim 5 further comprising a pair of score lines extending from said split to a point forming a triangular gusset.

8. The convertible food tray of claim 4 further comprising:

a hole in said sheet in close proximity to said score line for receiving and holding an eating utensil.

9. The convertible food tray of claim 4 further comprising:

a first slot cut in said sheet at said arcuate score line wherein said slot is large enough to pass the handle of an eating utensil; and a second slot cut in said sheet aligned with said first slot and spaced therefrom and located on the side of said arcuate score line remote from said second end edge.

10. A food tray comprising:

a generally rectangular sheet of flexible material of generally uniform thickness having two side edges, and first and second end edges;

said sheet comprises a concave area and a generally flat area wherein said concave area extends from and between said side edges and between one quarter and three quarters of the way from said first end edge to said second end edge wherein said sheet in said concave area has a general conical shape with an apex at its approximate center, and further wherein said sheet in the area of said apex is continuous whereby liquid material can be retained in said concave area and said generally flat area in said sheet extends from and between said two side edges and from said concave area to said second end edge wherein an area of said sheet adjacent said second end edge depends along an arcuate line and locates said second end edge in approximately the same horizontal plane as said apex of said concave area forming a foot for said food tray.

11. The food tray of claim 10 further comprising:

a recess in said first end edge approximately midway between said side edges for receiving the area of a hand between the thumb and the palm.

12. The food tray of claim 10 further comprising:

a hole in said sheet of flexible material in the generally flat area for receiving and holding a container.

* * * * *